United States Patent [19]

Colditz

[11] 4,298,804

[45] Nov. 3, 1981

[54] NEUTRON GENERATOR HAVING A TARGET

[75] Inventor: Johannes K. E. Colditz, Eindhoven, Netherlands

[73] Assignee: U.S. Philips Corporation, New York, N.Y.

[21] Appl. No.: 83,011

[22] Filed: Oct. 9, 1979

[30] Foreign Application Priority Data

Oct. 13, 1978 [NL] Netherlands ..... 7810299

[51] Int. Cl.[3] ..... G21G 4/02

[52] U.S. Cl. ..... 376/108; 376/151

[58] Field of Search ..... 250/499, 500; 313/61 R, 313/615

[56] References Cited

U.S. PATENT DOCUMENTS

| | | | |
|---|---|---|---|
| 3,646,348 | 2/1972 | Detaint | 313/615 |
| 3,683,190 | 8/1972 | Stark | 250/499 |
| 3,766,389 | 10/1973 | Fabian | 250/499 |

*Primary Examiner*—Bruce C. Anderson

*Attorney, Agent, or Firm*—Thomas A. Briody; David R. Treacy; Robert J. Kraus

[57] ABSTRACT

A neutron generator having a target which is hit by a beam of hydrogen ions. The target comprises a metal layer having a large coefficient of absorption for hydrogen, which is provided on a carrier layer of a metal having small coefficients of absorption and diffusion for hydrogen and a large coefficient of thermal conductivity, and a first intermediate layer of another metal having a large coefficient of thermal conductivity and a low sputtering ratio between the metal and the carrier layer. Between the carrier layer and the first intermediate layer a second intermediate layer of a metal, having a coefficient of linear expansion of a value which is between the coefficients of linear expansion of the carrier layer and the first intermediate layer, is present.

Such a target is suitable for being used in a neutron generator which is to provide a high neutron yield.

9 Claims, 2 Drawing Figures

NEUTRON GENERATOR HAVING A TARGET

The invention relates to a neutron generator having a target which is hit by a beam of hydrogen ions. The target comprises a first metal layer having a large coefficient of absorption for hydrogen which is situated on a carrier layer of a metal having small coefficients of absorption and diffusion for hydrogen and a large coefficient of thermal conductivity. Between the first metal layer and carrier layer there is a first intermediate layer of another metal having a large coefficient of thermal conductivity and a low sputtering ratio.

In such a neutron generator, neutrons are generated which are formed by reactions between nuclei of the heavy isotopes of hydrogen, deuterium and tritium. These reactions occur by bombarding a target containing deuterium and tritium with a beam of ions of deuterium and tritium which have traversed a potential difference of 150 to 250 kV. The deuterium and tritium ions are formed in an ion source in which a gas mixture of deuterium and tritium is ionized. The collision between a deuterium nucleus and a tritium nucleus provides a neutron having an energy of 14 MeV and an $\alpha$ particle having an energy of 3.6 MeV.

The target of such a neutron generator is usually formed by a thin layer having a large coefficient of absorption for hydrogen which is vapour-deposited on a carrier layer having small coefficients of absorption and diffusion for hydrogen. A metal from the group Ti, Zr, Sc, Y and the lanthanides is usually chosen for the hydrogen-absorbing layer and, for example, Cu or Ag is usually chosen for the metal of the carrier layer in view of the good thermal conductivity of said metals. The life of the hydrogen-absorbing metal layer is generally restricted by the sputtering away of the layer by the ion bombardment. Therefore, metals which sputter away comparatively slowly, for example Ti and Sc, are preferably chosen for the hydrogen-absorbing layer. The carrier layer must be cooled so as to dissipate the thermal energy released during the ion bombardment and the reactions. The thermal conductivity of the metal of the carrier layer must therefore be good. Therefore, Cu or Ag is preferably used as a material for the carrier layer.

The life of such targets is restricted because the beam of incident deuterium and tritium ions has an inhomogeneous density distribution. As a result of this, the thin hydrogen-absorbing layer is sputtered away comparatively rapidly at the location of the highest ion density so that the carrier layer becomes exposed after a short period of time. The metals of the carrier layer, for example, Cu and Ag, sputter away very rapidly, the remaining part of the hydrogen-absorbing layer being covered by a layer of Cu or Ag. As a result of this, the neutron efficiency decreases very rapidly, and there exists the danger that the ion beam may drill a hole through the carrier layer into the cooling system.

In order to prevent the phenomenon it is known to provide between the hydrogen-absorbing layer and the carrier layer an intermediate layer of a metal which can readily withstand the ion bombardment, which is not sputtered away rapidly, and which also has a good thermal conductivity. The intermediate layer also serves as a barrier to prevent hydrogen from diffusing to the carrier layer. Suitable materials for the intermediate layers are metals from the group Mo, W, Ta, Cr, Nb and Al.

A neutron generator of the kind mentioned in the opening paragraph is disclosed in British Patent Specification No. 974,622. This Specification describes a target the hydrogen-absorbing layer of which is provided on a carrier layer of, for example, Cu or Ni which is coated by a layer of, for example, Mo, W or Cr.

In order to obtain a good adhesion between the metals of the intermediate layer and the carrier layer, the metals of the intermediate layer may, for example, be vapour-deposited in an ultra-high vacuum on the metal of the carrier layer. In this manner, readily adhering intermediate layers can be vapour-deposited up to a thickness of approximately 15 $\mu$m.

In order to obtain high neutron efficiencies, large ion currents are necessary. It has been found that the life of targets having a single intermediate layer between the hydrogen-absorbing layer and the carrier layer may be undesirably short at high ion currents.

It has been found that at large ion currents the life of the intermediate layer is no longer determined by the sputtering away of the metal of the intermediate layer under the influence of the ion bombardment, but by so-called radiation damage. A part of the deuterium and tritium ions incident on the target in fact land in the thin intermediate layer. At low ion currents, the hydrogen again diffuses out of the intermediate layer so that an equilibrium situation occurs in which the same amount of hydrogen diffuses out of the intermediate layer as hydrogen lands in the intermediate layer. At high ion currents, however, the diffusion rate is too small for equilibrium to be attained so that hydrogen gas accumulates in a thin layer. This hydrogen gas forms gas bubbles in which the pressure may rise to such a high value that the gas bubbles burst so that the intermediate layer is broken open.

It is an object of the invention to provide a neutron generator having a target which is hit by a beam of hydrogen ions, in which the target has a longer life upon bombardment with beams of a high ion density.

SUMMARY OF THE INVENTION

According to the invention, a neutron generator having a target of the kind mentioned in the opening paragraph is characterized in that a second intermediate layer is present between the carrier layer and the first intermediate layer, said second layer being of a metal having a coefficient of linear expansion of a value which lies between the coefficients of linear expansion of the carrier layer and the first intermediate layer.

The invention is based on the recognition of the fact that, in order to prevent blistering of the intermediate layer in a short period of time by the so-called radiation damage, intermediate layers of larger thicknesses are necessary. The disadvantage of the provision of thicker intermediate layers of materials which readily withstand ion bombardments is that the adhesion of such intermediate layers to the carrier layer is unsatisfactory. As a matter of fact, the intermediate layers are vapour-deposited on the carrier layer at high temperatures. Upon cooling, thicker intermediate layers work loose locally due to the large difference in coefficient of linear expansion between the metals of the intermediate layer and the carrier layer. By providing a second intermediate layer between the first intermediate layer and the carrier layer, where the second layer is of a metal having a coefficient of linear expansion which is between the coefficients of linear expansion of the first layer and the carrier layer, it has proved possible to provide a first intermediate layer of a metal which readily withstands the ion bombardment with a thickness of a few hundred micrometers.

The metal for the hydrogen-absorbing layer is preferably chosen as a metal belonging to the group Ti, Zr, Sc, Y and the lanthanides, and the metal of the carrier layer is chosen as Cu or Ag.. Suitable metals for the first intermediate layer which readily withstand ion bombardments are metals belonging to the group Mo, W, Ta, Cr, Nb and Al. Particularly suitable metals for the second intermediate layer with a first intermediate layer of Mo, W, Ta, Cr or Nb are V and Ni. The coefficients of linear expansion of V and Ni lie between those of the metals of the carrier layer and the first intermediate layer, while the adhesion of V and Ni to both the metals of the carrier layer and to the metals of the first intermediate layer is good. With a first intermediate layer of Al, a suitable metal for the second intermediate layer is Ag, in which Cu should be used for the metal of the carrier layer. The coefficient of linear expansion of Ag is between that of Al and Cu.

By providing a second intermediate layer which has a thickness of at most 10 μm it has proved possible to vapour-deposit a first intermediate layer of a metal which has a thickness of at least approximately 15 μm. The first intermediate layer preferably has a thickness of approximately 100 μm.

The invention will now be described in greater detail with reference to the accompanying drawing.

DESCRIPTION OF THE PREFERRED EMBODIMENTS

Figure 1A:
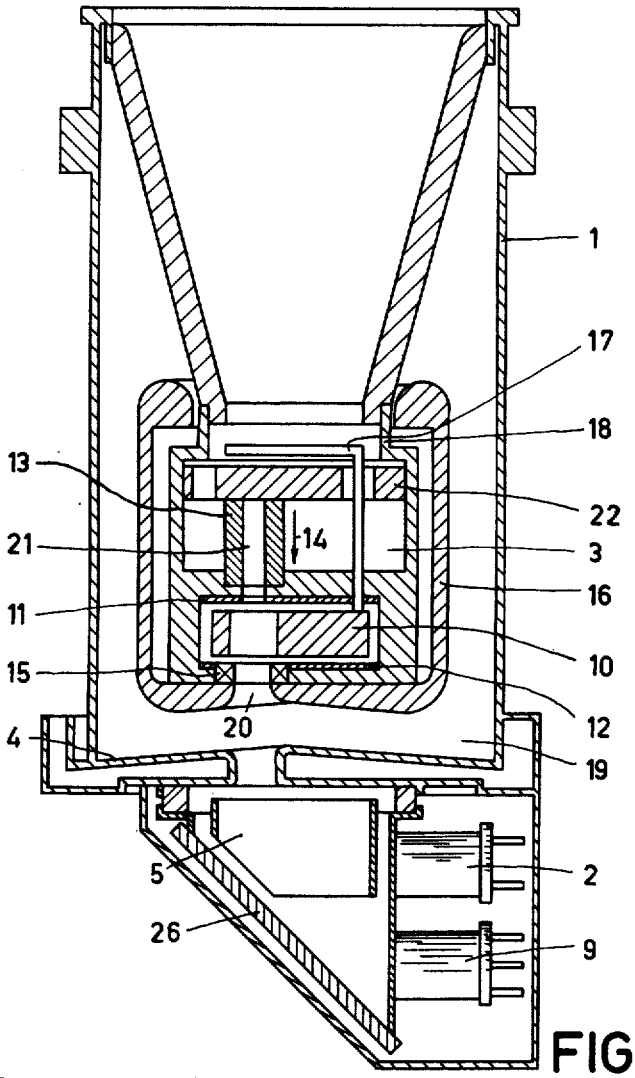
FIG. 1*a* shows cross-sectional view of a neutron generator in which the target according to the invention is used.

The neutron generator shown in FIG. 1*a* comprises in an envelope 1 a gas mixture consisting of 50% deuterium and 50% tritium with a pressure of $2-3\times10^{-3}$ mm Hg. The gas mixture is provided and its pressure is maintained at the correct value by a pressure control 2. The pressure control comprises a large quantity of the gas mixture absorbed in finely divided titanium powder which when heated can give off this gas. The gas pressure is monitored by means of an ionization pressure gauge 9.

The mixture of deuterium and tritium is ionized in the ion source 3, and a beam of positive deuterium ions and tritium ions is extracted from the ion source by the accelerating electrode 4. The ion source 3 is at a positive potential of 250 kV relative to the accelerating electrode 4.

The ion source 3 comprises an anode 10, a first cathode 11 and a second cathode 12. The cathodes 11 and 12 have the same potentials. The anode 10 has a positive potential of 4 kV relative to the cathodes 11 and 12. The ion source 3 furthermore comprises a permanent magnet 13 which is magnetized so that an axial magnetic field is formed having a main direction parallel to the arrow 14. A permanent magnetic ring 15 is magnetized so that the axial field is intensified in the proximity of the second cathode 12. The magnetic circuit of which the permanent magnets 13 and 15 form a part is closed beyond the anode 10 by the ferromagnetic sleeve 16. The anode voltage is supplied via the connection 17. The high voltage which brings the cathodes 11 and 12 at a potential of 250 kV relative to the accelerating electrode 4 is supplied via the connection 18.

The cathode 11 and the permanent magnet 13 have an axial bore 21. Negative ions and electrons, which are formed in the region 19 by ionization by the ion beam and which may have a large energy, are accelerated in the direction of the ion source. These particles pass through the ion exit aperture 20 and the bore 21 and are then incident on the collector electrode 22.

Figure 1B:
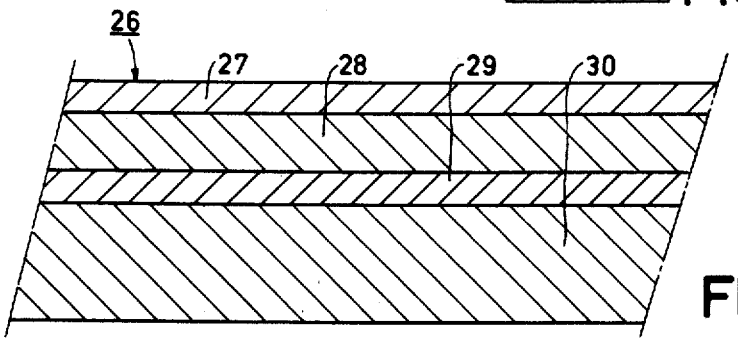
FIG. 1*b* shows a fragmentary cross-sectional view of the target shown in FIG. 1*a* on an enlarged scale.

The gas discharge in the ion source 3 results in an anode current of approximately 50 mA. The ion beam which is extracted from the ion source 3 has a current strength of approximately 20 mA. The ion beam formed passes the screen electrode 5 and is incident on the target 26. A part of the target 26 is shown in FIG. 1*b* on an enlarged scale.

The target 26 which is elliptical and has a major axis of approximately 7 cm consists of a carrier layer 30 of copper on which are provided successively a 5 μm thick layer 29 of vanadium, a 100 μm thick layer 28 of molybdenum and a 5 μm thick layer 27 of titanium.

The titanium layer 27 is saturated with deuterium and tritium. The ion beam, which is incident on the target in an accelerated manner, has a current strength of 20 mA and an energy of 250 KeV, which results in a neutron efficiency of approximately $10^{12}$ neutrons per second. The neutron efficiency arises mainly from the reaction between deuterium and tritium. The collision with an energy of 250 keV between a deuterium nucleus and a tritium nucleus provides a neutron having an energy of approximately 14 MeV and an alpha particle having an energy of 3.6 MeV. It is to be noted that neutrons are also formed to a small extent from the reaction between two deuterium nuclei. These neutrons have a much smaller energy. The neutrons having an energy of 14 MeV form the effective yield of approximately $10^{12}$ neutrons per second of the generator.

In order to prevent secondary electrons formed on the target 26 from being accelerated towards the ion source, the screen electrode 5 has a negative potential of a few hundred volts relative to the target 26. The ion current of approximately 20 mA required for neutron yields of approximately $10^{12}$ neutrons per second causes a large thermal load for the target. This thermal energy which is evolved in the titanium layer 27 is dissipated via the readily heat conducting layers 28 and 29 to the copper layer 30 which is cooled. Since the ion beam has an inhomogeneous intensity distribution, the titanium layer 27 is sputtered away comparatively rapidly at the location of the largest ion density. As a result of this, hydrogen also penetrates into the molybdenum layer 28. Since according to the invention, the molybdenum layer 28 has a thickness of 100 μm, the life of the molybdenum layer 28 is considerably extended. The provision of a molybdenum layer 28 of one hundred micrometers or more thickness is possible according to the invention by providing a thin vanadium layer 29 between the molybdenum layer 28 and the copper carrier layer 30. Since the coefficient of linear expansion of vanadium is between the coefficients of linear expansion of the molybdenum layer 28 and the copper carrier layer 30, the adhesion of the molybdenum layer 28 to the carrier layer 30 remains good upon cooling after vapour deposition at a temperature of approximately 400° C. This is also caused in that at these high temperatures the vanadium layer 29 diffuses slightly into the carrier layer 30 and the molybdenum layer 28.

What is claimed is:

1. In a neutron generator target to be hit by a beam of hydrogen ions, said target including (a) an outer layer of a metal having a large coefficient of absorption for hydrogen, (b) a carrier layer of a metal having small coefficients of absorption and diffusion for hydrogen and a large coefficient of thermal conductivity, and (c) a first intermediate layer of a metal having a large coefficient of thermal conductivity and a low sputtering ratio, said first intermediate layer being between said outer and carrier layers, the improvement in combination therewith of a second intermediate layer between said carrier and first intermediate layers, comprising a metal having a coefficient of linear expansion of a magnitude which is between that of the coefficients of linear expansion of said carrier and first intermediate layers, said outer, first intermediate, second intermediate and carrier layers being adhered together.

2. A target according to claim 1 wherein said outer layer comprises a metal selected from the group consisting of Ti, Zr, Sc, Y and the lanthanides, and said carrier layer comprises Cu or Ag.

3. A target according to claims 1 or 2 wherein said first intermediate layer comprises an element selected from the group consisting of Mo, W, Ta, Cr and Nb, and said second intermediate layer comprises V or Ni.

4. A target according to claims 1 or 2 wherein said first intermediate layer comprises Al, said second intermediate layer comprises Ag, and said carrier comprises Cu.

5. A target according to claim 1 wherein said second intermediate layer has a maximum thickness of 10 μm.

6. In a neutron generator target to be hit by a beam of hydrogen ions, said target including (a) an outer layer of a metal having a large coefficient of absorption for hydrogen, (b) a carrier layer of a metal having small coefficients of absorption and diffusion for hydrogen and a large coefficient of thermal conductivity, and (c) a first intermediate layer of a metal having a large coefficient of thermal conductivity and a low sputtering ratio, said first intermediate layer being between said outer and carrier layer, the improvement in combination therewith of a second intermediate layer between said carrier and first intermediate layers, said second intermediate layer having a maximum thickness of 10 μm and comprising a metal having a coefficient of linear expansion of a magnitude which is between that of the coefficients of linear expansion of said carrier and first intermediate layers, said outer, first intermediate, second intermediate and carrier layers being adhered together.

7. In a neutron generator target to be hit by a beam of hydrogen ions, said target including (a) an outer layer of a metal having a large coefficient of absorption for hydrogen, (b) a carrier layer of a metal having small coefficients of absorption and diffusion for hydrogen and a large coefficient of thermal conductivity, and (c) a first intermediate layer of a metal having a large coefficient of thermal conductivity and a low sputtering ratio, said first intermediate layer being between said outer and carrier layers, the improvement in combination therewith of a second intermediate layer between said carrier and fist intermediate layers, said first intermediate layer having thickness of at least 15 μm and said second intermediate layer comprising a metal having a coefficient of linear expansion of a magnitude which is between that of the coefficients of linear expansion of said carrier and first intermediate layers, said outer, first intermediate, second intermediate and carrier layers being adhered together.

8. A target according to claim 7 wherein said first intermediate layer has a thickness of approximately 100 μm.

9. A target according to claim 1 wherein said carrier layer is Cu, said second intermediate layer is V approximately 5 μm thick, said first intermediate layer is Mo approximately 100 μm thick, and said outer layer is Ti approximately 5 μm thick, said second and first intermediate layers and said outer layer being successively vapor-deposited on said carrier layer.

* * * * *